US005101818A

United States Patent [19]

Chace et al.

[11] Patent Number: 5,101,818

[45] Date of Patent: Apr. 7, 1992

[54] SNORKELING SYSTEM

[75] Inventors: John P. Chace; Brandon Chace, both of Orlando, Fla.

[73] Assignee: Diving Innovations, Orlando, Fla.

[21] Appl. No.: 572,872

[22] Filed: Aug. 24, 1990

[51] Int. Cl.[5] ..... A62B 7/00; B63C 11/16

[52] U.S. Cl. ..... 128/202.14; 128/201.11; 405/186; 441/117

[58] Field of Search ..... 128/202.14, 201.11, 128/201.27; 441/88, 90, 114, 115, 117; 405/186

[56] References Cited

U.S. PATENT DOCUMENTS

| | | | |
|---|---|---|---|
| 3,138,155 | 6/1964 | Bould | 405/186 |
| 3,345,984 | 10/1967 | Katehis | 128/201.11 |
| 3,536,071 | 10/1970 | Ferrando | 128/202.14 |
| 3,747,140 | 7/1973 | Roberts | 405/186 |
| 3,866,253 | 2/1975 | Sinks et al. | 128/202.14 |

FOREIGN PATENT DOCUMENTS

| | | | |
|---|---|---|---|
| 2163962 | 3/1986 | United Kingdom | 128/201.11 |

*Primary Examiner*—Edgar S. Burr
*Assistant Examiner*—Stephen R. Funk
*Attorney, Agent, or Firm*—Malin, Haley, McHale, DiMaggio & Crosby

[57] ABSTRACT

A dive vest and snorkel system is provided. The dive vest is constructed of air and water impervious material having an inflation chamber capable of receiving and storing air and further having an exhaust port which automatically exhausts the air stored in the inflation chamber when the wearer of the dive vest places the headmost end of the dive vest lower than the exhaust port prior to diving below the water's surface.

The snokel has a tube with a mouthpiece at one end and has means for constricting the opening at the other end of the tube. These means may be either placing the snorkeler's hand in sealing contact with the end of the tube or placing a cap in sealing contact with the end of the tube by pulling a pull ring connected to pull cords which are in turn attached to the cap. The snorkel also has means for directing exhalant from the user to the inflation chamber of the dive vest and preventing the escape of air within the exhaust chamber through the means for directing exhalant from the user to the inflation chamber.

The dive vest or snorkel may be used individually as well as in combination with each other.

29 Claims, 3 Drawing Sheets

SNORKELING SYSTEM

BACKGROUND OF THE INVENTION

1. Field of the Invention

The instant invention relates to devices for aiding snorkelers while snorkeling and more particularly relates to devices for providing buoyancy control in combination with an improved breathing device for use while snorkeling.

2. Description of Related Art

Many devices exist which combine buoyancy vests with means or inflating the vests that include, in part, means for inflating the vest with the user's own exhaled breath Exemplary of these devices are U.S. Pat. No. 3,536,071, issued to Ferrando on Oct. 27, 1970; U.S. Pat. No. 4,498,882, issued to Evert on Feb. 12, 1985; and U.S. Pat. No. 4,778,307, issued to Faulconer on Oct. 18, 1988. However, none of these prior art devices are directed specifically for use by a snorkeler, and in particular, none of the devices are dive vests for use by a snorkeler that automatically vent air from within the vest when diving and are combined with an improved snorkel that assists in the inflation of the dive vest.

In addition, snorkels exist which allow air to enter the snorkel tube through a series of air holes in the upper end of the snorkel, as disclosed in U.S. Pat. No. 3,139,087, issued to Liberatore on June 30, 1964. Further, snorkels exist which allow air to enter the snorkel through a point other than the end of the snorkel tube, and then enter the snorkel tube after following a serpentine path. Exemplary of these devices are those patented under U.S. Pat. Nos. 2 753 865 issued to Kogel on July 10, 1956 3,908,647, issued to Taunton on Sept. 30, 1975, 4,071,024, issued to Blanc on Jan. 31, 1978, and 4,782,830, issued to Forman on November 8, 1988. However, none of these prior art devices provide a manually actuated means for constricting the air flow out of the snorkel tube to assist in using the snorkeler's exhaled breath to inflate a buoyancy vest.

In addition, snorkels exist which have purged valves located near the mouthpiece of the snorkel to allow accumulated water or exhaled air to be directed away from the snorkel. Exemplary of these devices are U.S. Pat. Nos. 3,860,042, issued to Green on January 14, 1975 and 4,879,995, issued to Christianson on Nov. 14, 1989.

SUMMARY OF THE INVENTION

A dive vest is provided which is worn on the ventral or front side of a snorkeler. The dive vest is preferentially attached to the snorkeler around the neck and legs of the snorkeler and extends essentially from the neck area of the snorkeler to an area between the crotch and the knees of the snorkeler. The dive vest is essentially an air bladder formed by attaching two pieces of water and air impervious material together to form an internal inflation chamber. The inflation chamber is sealed on three sides, leaving open in the preferred embodiment, an exhaust port at the bottom or most legward part of the dive vest. The water and air impervious material may be of any number of kinds of such materials as is common with other types of dive vests.

A hollow inflation tube is sealingly connected to the dive vest preferably at the most headward end of the dive vest. The inflation tube allows air to be passed into the inflation chamber of the dive vest. The other end of the inflation tube is preferentially attached to the exit port of a common purge valve on a snorkel. In another embodiment of the invention the purge valve is located where the inflation tube attaches to the inflation chamber.

This purge valve operates in such a way that the movement of air from the snorkel into the inflation tube is controlled. In particular, the purge valve prevents air under pressure in the inflation chamber from exiting the inflation chamber through the inflation tube and either exiting to the outside through the purge valve or exiting back into the snorkel.

In addition, as shall be explained shortly, air under pressure provided by the diver's exhaled breath may be passed through the purge valve into the inflation tube in the preferred embodiment or through the inflation tube and then through the purge valve where it enters the inflation chamber. In this regard, the purge valve operates to pass air into the inflation chamber and keep it from escaping from the inflation chamber. When the purge valve is located on the snorkel, the purge valve passes air into the inflation tube and keeps it from re-entering the snorkel in exactly the same manner that water is traditionally passed out of the purge valve and prevented from re-entering the snorkel.

Although embodiments of the invention have been described where the purge valve is located in the snorkel or where the inflation tube enters the inflation chamber, it is also within the scope of the invention to include purge valves in both places in an embodiment or to move the purge valve to any other location so long as air may be directed into the inflation chamber and prevented from escape therefrom.

The snorkel itself is modified with an improved water interfacing end. The improved end serves the dual purpose of preventing water from entering the tube of the snorkel itself, and interacts with the purge valve to direct air under pressure through the inflation tube into the inflation chamber.

In operation, the dive vest is worn on the front of the diver and is attached to the diver as explained above. The snorkeler then places the snorkel mouthpiece in his mouth and proceeds to enter the water. Immediately upon entry into the water, the snorkeler, while in a substantially vertical position fills the inflation chamber with air, as will be described hereafter, thus providing a floating cushion upon which the snorkeler may rest in a prone or semi-prone position while floating in the water.

The difference in specific weights between air and water causes the air present in the inflation chamber to rise to the top of the inflation chamber in response to the water pressure from the water. Because the exhaust port of the dive chamber is at a lower elevation than the upper part of the inflation chamber, no air will escape through the exhaust port despite there being no sealing means present.

Inflation of the inflation chamber takes place in the preferred embodiment by first closing the water interfacing end of the snorkel. The diver then forcibly exhales into the snorkel through the mouthpiece thereby forcing air under pressure through the purge valve into the inflation chamber.

In an alternative embodiment, the diver may simply blow directly into the inflation tube thereby forcing air past the purge valve located between the inflation tube and the inflation chamber.

With the inflation chamber filled, the snorkeler may swim across the surface of the water at his leisure in a relaxed manner. Because the inflation chamber provides buoyancy for the diver, the snorkeler need not exert any additional effort in order to maintain a prone or semi-prone position in the water, despite any natural tendency the individual snorkeler may have not to float. In fact, the snorkeler may remain completely motionless in the prone or semi-prone position while floating in the water, allowing the snorkeler to effortlessly rest on the surface of the water or view the underwater scenes through a snorkeler's dive mask.

If the snorkeler desires to dive below the water surface, the snorkeler need only pull his knees up to his chest and rotate his body into the familiar dive position in a manner well known to ordinary snorkeling. In this configuration, the snorkeler's head will be lower than the snorkeler's leg area. This results in the exhaust port being the highest point of the dive vest, allowing air stored in the inflation chamber to vent through the exhaust port, thereby leaving the dive vest. Because the air is removed from the inflation chamber, the dive vest loses its buoyancy, thus allowing the snorkeler to dive below the water surface. It is important to note that the venting of air from the inflation chamber through the exhaust port occurs automatically when the snorkeler assumes the traditional snorkeling dive position.

If the snorkeler desires to remain underwater with no extra effort required, the snorkeler may wear a weight belt around his waist. Whether the weights are worn between the snorkeler's body and the improved dive vest or on the outside of the vest, experience has shown that the air within the inflation chamber is automatically vented as the diver turns to dive as described above. While on the surface, the negative buoyant effect of the weight belt may be counteracted by inflating the improved dive vest allowing the snorkeler to remain motionless on the surface of the water. At a time of the snorkeler's choosing, the snorkeler may attain the dive position previously mentioned, thereby automatically venting air from the inflation chamber through the exhaust port. The snorkeler's natural buoyant tendency is rendered neutral or negative by using the weights, depending on the amount of weights used, so that the snorkeler does not have to hold on to the bottom or swim to remain below the water's surface.

Having briefly described the invention in the foregoing, the invention will now be described in detail with particular reference to the accompanying drawings where like numbers refer to like elements.

DETAILED DESCRIPTION OF THE INVENTION

Figure 1:
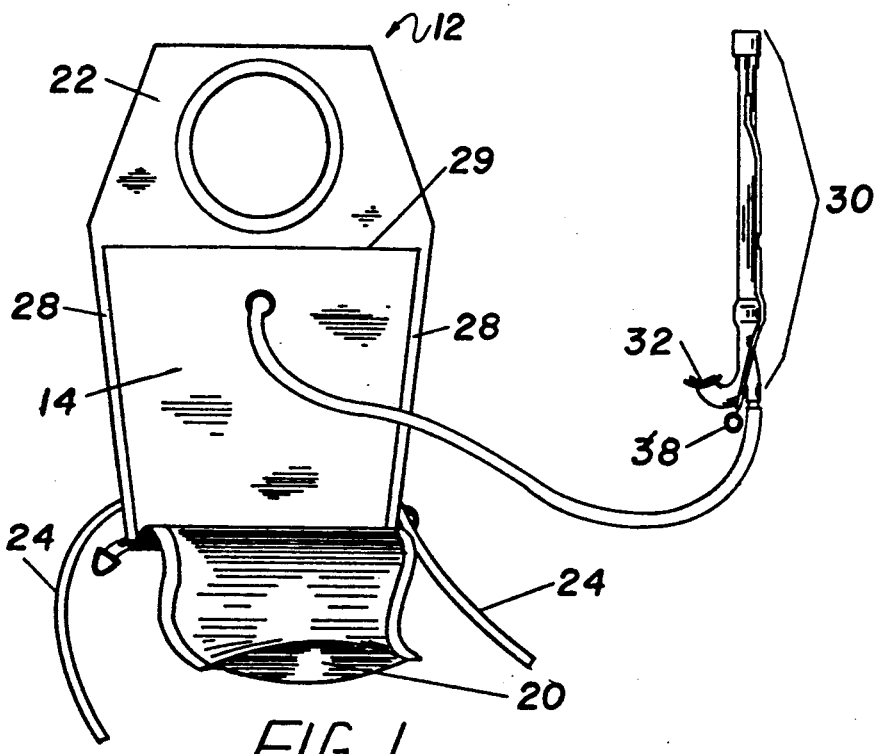
FIG. 1 is a front elevational view of the improved dive vest and snorkel.

The improved dive vest is shown generally in FIG. 1 by the numeral 12, while the improved snorkel is shown generally by the numeral 30. The dive vest 12 is preferentially constructed by joining together two substantially elongated pieces of water and air impervious material by side seams 28 and top seam 29 to form an inflation chamber 14. The sealing of side and top seams 28, 29 may be by any well known method. Inflation chamber 14 is defined by sealed side seams 28, top seam 29 and exhaust port 20 which, in the preferred embodiment, is an unsealed edge opposite top seam 29. Inflation chamber 14 is located between the two pieces of air and water impervious material. In addition, in the preferred embodiment, side seams 28 taper towards each other from top seam 29 to exhaust port 20.

Neck strap 22 holds the dive vest 12 in position around the snorkeler's neck In addition to neck strap 22, waist straps 24 are provided to hold the dive vest 12 in position at the front of the diver. In the preferred embodiment, waist straps 24 are attached to side of the vest 12 closest to the diver at an area corresponding to the crotch of the diver. The waist straps 24 may then be placed between the legs of the diver and then brought around the diver's waist through rings attached to the sides of the vest 12 where waist straps 24 may be joined Waist straps 24 may be joined by any of a number of common methods for joining straps including, but not limited to, a buckle assembly or a hook and loop closure system such as that marketed under the trademark VELCRO. Dive vest 12 is of a sufficient length so that exhaust port 20 will be at a position between the diver's crotch and knees when the dive vest 12 is worn by the snorkeler.

Figure 6:
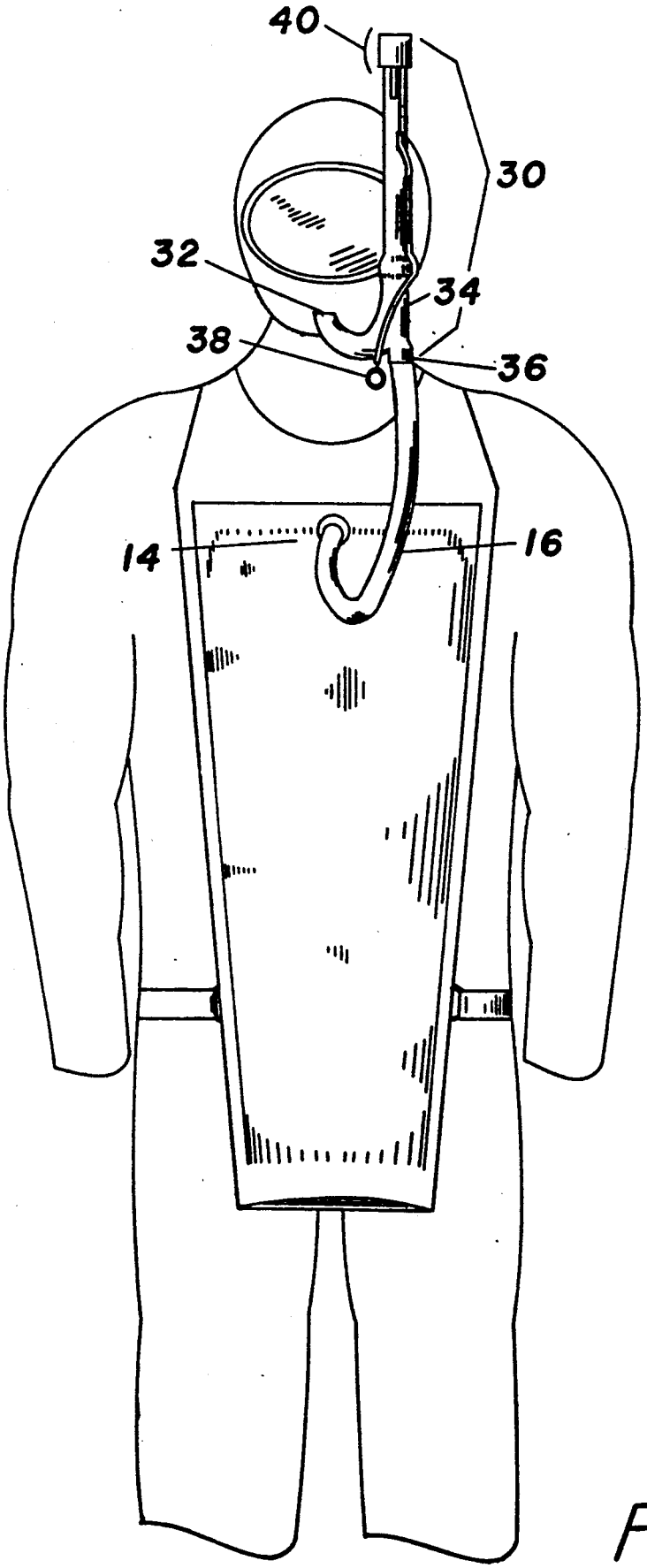
FIG. 6 is a front view of a human snorkeler wearing the improved system.

As shown in FIG. 6, a snorkeler is provided with a snorkel generally designated as 30, as described hereafter, to allow the snorkeler to breath while swimming on the surface of the water with the snorkeler's face in the water. The snorkel 30 is of the basic "J"-shaped variety having a tube 34 with a mouthpiece 32. In the preferred embodiment, a purge valve 36 is provided, such as is common to snorkels, to allow water within the snorkel to be easily expelled. However, instead of allowing only accumulated water to be vented from the tube 34, purge valve 36 is attached to inflation chamber 14 via inflation tube 16 to allow the diver's exhaled breath to be expelled through purge valve 36 as will be explained hereafter. Inflation tube 16 is attached to inflation chamber 14 near the end of the inflation chamber 14 nearest the head of the snorkeler.

Purge valve 36 and inflation tube 16, work together with cap assembly 40 to direct air expelled from the snorkeler through mouthpiece 32 into tube 34 and subsequently into inflation chamber 14. This is done through the interaction of purge valve 36 and the mechanism of cap assembly 40 which is shown in greater detail in the embodiment of FIGS. 2 and 3 and the embodiment of FIGS. 4 and 5.

In an alternate embodiment, a purge valve 36 may be placed where the inflation tube 16 enters the inflation chamber 14. Inflation tube 16 may or may not be attached to a snorkel as desired. If inflation tube 16 is not attached to a snorkel, a diver may force air into the inflation chamber 14 by blowing directly into inflation tube 16.

It has been found that it is much easier to force air into inflation chamber 14 through inflation tube 16 if inflation tube 16 has an inside diameter of at least ¾". This prevents a pressure build-up within inflation tube 16 which hinders blowing air into inflation chamber 14.

Figure 2:
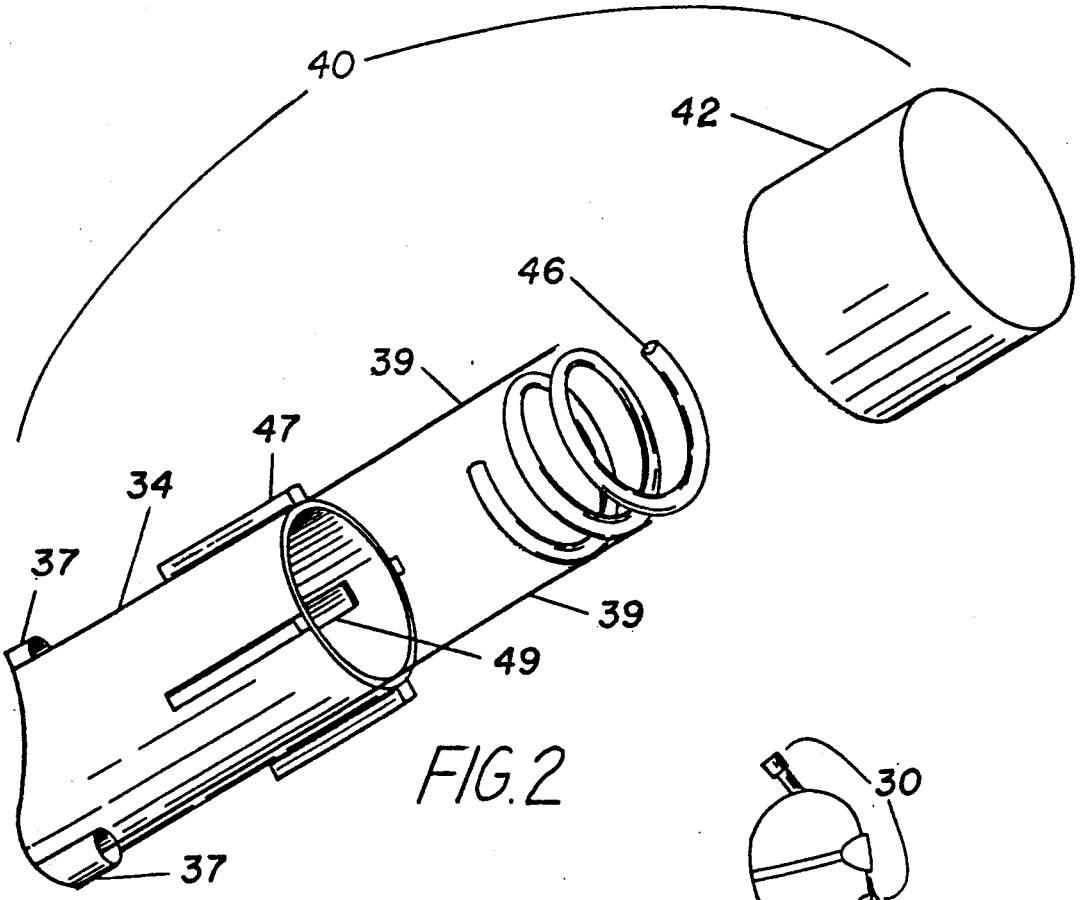
FIG. 2 is an exploded view of the preferred embodiment of the cap on the snorkel shown in FIG. 1.
Figure 3:
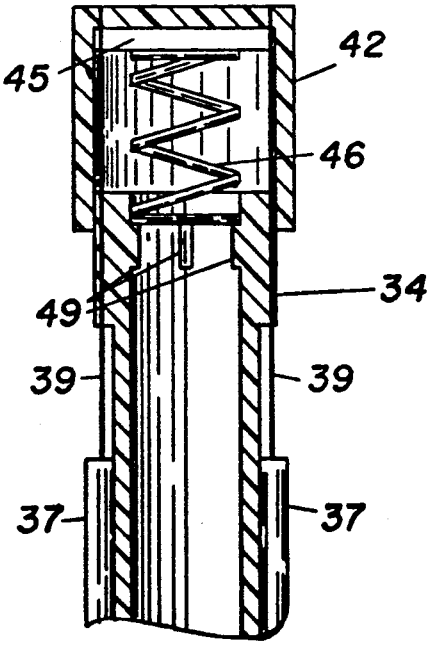
FIG. 3 is a sectional view of the assembled cap shown in FIG. 2.
Figure 7:
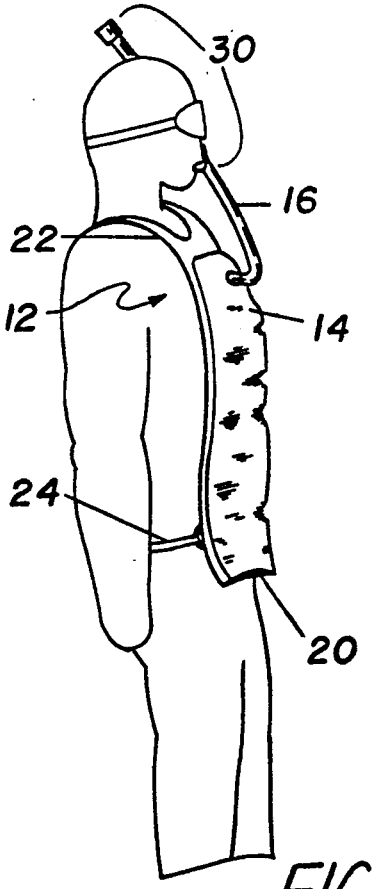
FIG. 7 is a side elevational view of a human snorkeler wearing the improved system.

FIG. 2 shows an exploded view and FIG. 3 shows a vertical cross-sectional view of the individual components of the preferred embodiment of cap assembly 40. Cap 42 is a cup shaped component with the open end directed toward tube 34. Cap 42 has an inside diameter slightly larger than the outside diameter of tube 34. In operation, cap 42 is placed over the end of tube 34 where it is positioned a uniform distance away from tube 34 by a plurality of spacers 47 located colineally along the outside of tube 34. Air may then pass from outside cap assembly 40 along tube 34 and into cap 42, or vice versa, in between spacers 47.

A seal 45 is placed in the inside of cap 42 at the closed end of cap 42. Seal 45 is made of a pliable air impervious material. When cap 42 is brought near the top of tube 34, through cap 42 sliding along spacers 47 as will be described hereafter, seal 45 forms an airtight seal with the top of tube 34. This airtight seal prevents air from moving either into or out of tube 34.

A spring 46, located within tube 34 and cap 42, biases cap 42 away from tube 34. In this way, seal 45 does not form an airtight seal with tube 34 unless the bias of spring 46 is overcome as will be described hereafter. Spring holders 49, located within tube 34, position one end of spring 46 within and at the end of tube 34. The other end of spring 46 is in contact with cap 42. This contact with cap 42 may be directly with cap 42 or may be through contact with seal 45.

Pull cords 39 are attached to cap 42 through the inside of cap 42. In the preferred embodiment, a single pull cord 39 is attached to cap 42 from within cap 42 and extends downward through tube 34 where it exits tube 34 below mouthpiece 32 through a sealed opening. The sealed opening prevents water from entering or air from leaving tube 34. Pull cord 39 ends in a pull ring 38 which facilitates grasping by the user.

In an alternate embodiment, pull cords 39 extend along the sides of tube 34 through the space between cap 42 and tube 34 created by spacers 47. Pull cord tubes 37 containing pull cord 39 are placed along tube 34. In this embodiment, there are preferably two pull cords 39 and consequently two pull cord tubes 37 located on opposite sides of the top of tube 34.

The two pull cord tubes 37 containing pull cords 39 in the alternate embodiment join together along tube 34 to form a single tube containing both pull cords 39. This single pull cord tube 37 extends along tube 34 to a position in front of the mouthpiece 32 of the snorkel 30. At the mouthpiece 32, pull cords 39 exit pull cord tube 37 and end in a pull ring 38. Pull ring 38 allows pull cords 39 to be easily pulled through pull cord tubes 37.

The positioning of pull cords 39 and pull ring 38 in front of the mouthpiece 32 of the snorkel in both embodiments allows the user to bite down on mouthpiece 32 thereby resisting the natural tendency of the snorkel 30 to be pulled along with pull ring 38. In this way biting mouthpiece 32 provides a counter force to the force applied to pull cords 39 by pulling pull ring 38. This pull of pull cords 39 by pull ring 38 pulls cap 42 into an airtight seal with the end of tube 34 through seal 45

The exhalant from the snorkeler directed into tube 34 of snorkel 30 through mouthpiece 32 then opens the bias of purge valve 36 allowing the exhalant to enter inflation chamber 14 through inflation tube 16. When the snorkeler's exhalant no longer has sufficient pressure to overcome the bias of purge valve 36, purge valve 36 closes preventing air in inflation chamber 14 from escaping through either purge valve 36 or inflation tube 16.

Figure 4:
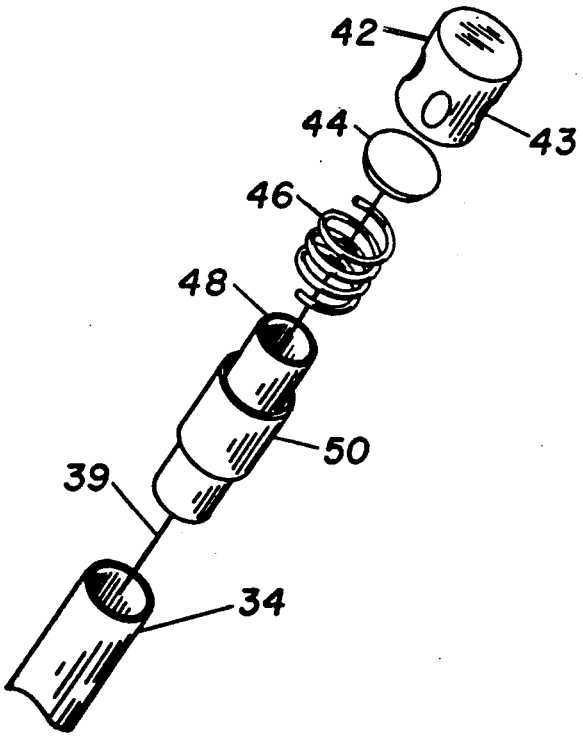
FIG. 4 is an exploded view of an alternate embodiment of the cap on the snorkel shown in FIG. 1.
Figure 5:
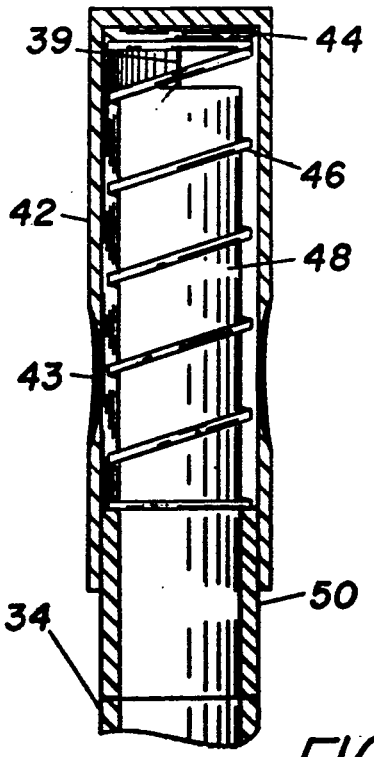
FIG. 5 is a sectional view of the assembled cap shown in FIG. 4.

FIG. 4 shows an exploded view of the individual components of an alternate embodiment cap assembly 40. Cap 42 is a cup-shaped component having a plurality of holes 43 drilled through the sides of cap 42 transverse to the longitudinal axis of cap 42. Disk shaped gasket 44 is attached to a spring 46. Spring 46 is preferably conical in shape to facilitate compression into a collapsed configuration. However other shapes, such as cylindrical, for spring 46 may also be used. Gasket 44 is made of a resilient, flexible material and has a unstressed diameter approximately equal to the inside diameter of cap 42. Gasket 44 may also have an upward bend to facilitate sealing with inner tube 48 as will be explained hereafter.

Inner tube 48 is securely placed within outer sleeve 50. Inner tube 48 is preferably made of a sturdy material such as plastic and has an outside diameter equal to the inside diameter of tube 34 so that inner tube 48 may fit securely within the top of tube 34. Outer sleeve 50, in turn, is preferably made of plastic and has an outside diameter equal to the inside diameter of cap 42, so that outer sleeve 50 fits securely in the lower portion of cap 42. In one embodiment, spring 46 fits inside and is supported within inner tube 48. In an alternate embodiment, spring 46 has an inside diameter slightly larger than the outside diameter of inner tube 48 so that spring 46 fits over and is supported by the outside of inner tube 48 above outer sleeve 50.

In its assembled position, cap assembly 40 in an alternate embodiment comprises cap 42 containing gasket 44 biased against the top of cap 42 by the compression of spring 46, as spring 46 is placed around the top portion of inner tube 48, and as outer sleeve 50 is placed in contact with the lower portion of cap 42. This configuration compresses spring 46 between the gasket 44, which is biased by the spring 46 against the top of cap 42, and outer sleeve 50. The lower portion of inner tube 48 is securely placed in the upper portion of tube 34. In addition, pull cord 39 is attached to center of gasket 44 and extends through the center of inner tube 48 into tube 34.

Pull cord 39 descends from the cap assembly 40 through tube 34 to the area of purge valve 36. There, pull cord 39 exits tube 34 through a seal so as to prevent the movement of air and water out of or into tube 34 respectively. Pull ring 38 is attached to the end of pull cord 39 outside of tube 34 so that the snorkeler may grasp pull ring 38 and pull pull cord 39. By pulling pull cord 39, gasket 44 may be moved from its biased position against the top of cap 42 into a sealing position with the top of inner tube 48.

In ordinary operation, spring 46 biases gasket 44 against the inside top part of cap 42. Air may then enter cap 42 through holes 43. Air then moves down through the top part of inner tube 48 into tube 34 where it is presented to the snorkeler's mouth at mouthpiece 32. In this configuration, the snorkeler breaths as normal through mouthpiece 32 and air enters and exits the snorkel 30 through holes 43 in cap 42.

In this alternative embodiment, when the snorkeler desires to inflate the inflation chamber 14, the snorkeler pulls on pull ring 38 which in turn pulls pull cord 39.

This pulls gasket 44 from its biased position against the top of cap 42 into sealing contact with the top portion of inner tube 48. Thereafter, when the snorkeler exhales through mouthpiece 32 into tube 34, the exhalant under pressure opens the bias of purge valve 36 so that the exhalant under pressure travels through inflation tube 16 into inflation chamber 14. When the snorkeler's exhalant no longer has sufficient pressure to overcome the bias of purge valve 36, purge valve 36 closes thereby preventing the air within inflation chamber 14 from exiting inflation chamber 14 through purge valve 36 into tube 34.

It should also be noted that any water present in tube 34 will also be expelled through purge valve 36 into inflation chamber 14 in either embodiment of cap 40. However, because inflation chamber 14 is, in the preferred embodiment of the structure of exhaust port 20, open along exhaust port 20, this expelled water will exit inflation chamber 14 through exhaust port 20. Therefore, the improved snorkel 30 allows both air and water to be expelled from the tube 34 through purge valve 36.

In either embodiment of cap assembly 40, the snorkeler may blow an air bubble into tube 34 through mouthpiece 32 as the snorkeler assumes the dive position and descends below the surface of the water. This air bubble will travel through tube 34 where it will come in contact with cap 42. Because cap 42 is an inverted cup shape, the air bubble will get trapped in the closed end of cap 42. The air bubble in this position will prevent water from entering the top of tube 34 through the openings along spacers 47 or through holes 43. Because water is prevented from entering tube 34 while the snorkeler is under water, the snorkeler will not need to blow out the water ordinarily found in the tubes of ordinary snorkels upon reaching the water's surface. Since blowing water out of a snorkel tube is very tiring to snorkelers, the instant invention provides a snorkel that is much less tiring to use than ordinary snorkels. When the snorkeler returns to the surface, because tube 34 is clear of water, the snorkeler may immediately take a breath through snorkel 30.

Although specific structures have been described which seal the end of tube 34, it is also within the scope of the invention to have a snorkel 30 without a cap 40 on tube 34 which tube 34 may be sealed by placing the snorkeler's hand in sealing contact over the end of tube 34.

In operation, the dive vest 12 is attached to the snorkeler by placing neck strap 22 around the neck of the snorkeler. Waist strap 24 may be attached around the snorkeler's waist so that dive vest 12 is held in position on the front side of the snorkeler. The dive vest 12 extends from the snorkeler's neck down to an area between the crotch and knees of the snorkeler. The snorkeler then enters the water whereupon air may be placed in the inflation chamber 14. This is done by pulling on pull ring 38 and blowing into the mouthpiece 32 as described above or by blowing directly into inflation tube 16, depending on the embodiment. Air is then forced through purge valve 36 and inflation tube 16 into inflation chamber 14. There, due to the pressure of the water, air in chamber 14 will tend to rise to the upper or neck portion of inflation chamber 14, which is directly opposite exhaust port 20. In this way, air placed in inflation chamber 14 will remain within inflation chamber 14 and not exit through exhaust port 20. Also, because of the tapered shape of inflation chamber 14 as mentioned above, air within inflation chamber 14 will tend to be bottled up in the top portion of inflation chamber 14. This tapering provides an additional aid to hinder air from escaping out of exhaust port 20.

In addition to the natural orientation and tapering of the inflation chamber 14 which prevent air from escaping from exhaust port 20, a small weight may be added to the side of the open seam embodiment of the exhaust port 20 closest to the body of the snorkeler. This small weight will be pulled downward by gravity when the dive vest 12 is inflated and the snorkeler is in a prone or semi-prone position. This downward orientation of this part of exhaust port 20 will tend to seal the opposite sides of the open seam of exhaust port 20, thereby further hindering the escape of air from inflation chamber 14.

Air in inflation chamber 14 will act in addition to the snorkeler's natural buoyancy thereby comfortably supporting the snorkeler on an effective air pillow in the water in a prone or semi-prone position. This will allow the snorkeler to effortlessly remain on the surface of the water. In this position the snorkeler may rest or observe the underwater scenery by means of an ordinary dive mask, without any exertions to keep from sinking or to maintain the prone or semi-prone position. By maintaining the snorkeler in the prone or semi-prone position, the invention also facilitates easy travel through the water with a minimum of effort by ordinary strokes involving the arms and legs.

When the snorkeler desires to descend beneath the surface of the water, the snorkeler may bring his legs up to his chest and rotate his body so that his head is in a downward position. This orientation places exhaust port 20 above the upper part of inflation chamber 14. Air will then exit inflation chamber 14 through exhaust port 20 allowing the weight of the snorkeler to drive the snorkeler beneath the surface of the water.

If additional negative or neutral buoyancy is desired, a weight belt having appropriate weights may be attached to the snorkeler around the snorkeler's waist. The negative or neutral buoyant effect of the weight belt can be compensated while floating on the surface of the water by an additional amount of air placed in inflation chamber 14 as described in this disclosure. To descend below the water with a dive belt, the snorkeler proceeds exactly as above by bringing his knees to his chest and rotating into the traditional dive position. Air within inflation chamber 14 will then be vented through exhaust port 20 with the result that the net positive buoyancy caused by the air within inflation chamber 14 will be replaced by net negative buoyancy caused by the dive belt, thereby allowing the snorkeler to remain underwater with no additional effort.

Although in the preferred embodiment, inflation chamber 14 is bounded on one side by exhaust port 20 which is an opening formed between the two pieces of water and air impervious material making up inflation chamber 14 and which has no form of closure, exhaust port 20 may be equipped with any of a number of closures which are easy to open and close. When using this embodiment, the snorkeler must manually open exhaust port 20 as the snorkeler moves into the traditional dive position. For example, a hook and loop closure system such as that sold under the trademark VELCRO may be used to close exhaust port 20 Using this system it has been found that the end of inflation chamber 14 containing exhaust port 20 can effectively be sealed by rolling up this end of inflation chamber 14 along an axis parallel to exhaust port 20 and then securing the resulting rolled up end by appropriately placed hook and loop closures running along this parallel axis. The exhaust port 20 may be closed to seal inflation chamber 14 prior to blowing air into the inflation chamber 14 to provide buoyancy. While a particular embodiment of a closure system for exhaust port 20 has been described, it is given by way of illustration and not by way of limitation. Any type of closure which is easy to open and close such as a closure sold under the trademark ZIPLOC is within the scope of this invention.

The instant invention is intended to be used as an aid to snorkelers and the like. It eliminates many of the tiring aspects of snorkeling thereby making snorkeling more enjoyable and safe. Although the dive vest is not intended to be primarily used as a life preserver, it is recognized that it may be used as such and that it has inherent characteristics which are useful to snorkelers or other users who may become tired in the water or who could use a flotation device.

Further, the dive vest 12 or snorkel 30 may be used individually as well as in combination with each other.

The instant invention has been described in what is considered to be the preferred embodiment. Although the description of the invention was given in the form of the preferred embodiment, it is to be understood that the description is given by means cf example and not by means of limitation. It is understood that additions and modifications to the description may be made within the scope of the invention Further, obvious changes and modifications will be apparent to one skilled in the art.

What is claimed is:

1. A dive vest and snorkel combination for use by a diver comprising a dive vest made of air and water impervious material, said dive vest having a head end attached to said diver's neck and shoulder area, and an opposing end opposite said head end, said dive vest including an inflation chamber capable of receiving and storing air, said inflation chamber having a head end, corresponding to said head end of said dive vest, and a bottom end, corresponding to said opposing end of said dive vest, said inflation chamber having an exhaust port, said exhaust port being arranged to automatically vent air within said inflation chamber to the exterior of said dive vest when said diver places the said head end of said dive vest below said exhaust port preparatory to diving below the water's surface; and a snorkel having a tube with a first and second end, said first end having a mouthpiece, said snorkel also having means for constricting said second end of said tube whereby air is constricted from moving in or out of said second end of said tube, said snorkel further having means for directing exhalant from said diver into said inflation chamber, and further having means for preventing air within said inflation chamber from exiting said inflation chamber through said means for directing exhalant from said diver into said inflation chamber.

2. The device of claim 1 wherein said exhaust port comprises a non-sealed opening in said inflation chamber, said non-sealed opening located at said bottom end of said inflation chamber whereby air is maintained within said inflation chamber by hydrostatic pressure when said head end of said inflation chamber is higher than said non-sealed opening and whereby air within said inflation chamber is automatically vented out of said inflation chamber through said non-sealed opening when said non-sealed opening is moved level to or above said head end of said inflation chamber.

3. The device of claim 1 wherein said exhaust port comprises: an opening; and, means for selectively sealing said opening whereby air is maintained within said inflation chamber by hydrostatic pressure when said head end of said inflation chamber is higher than said opening and by said means for selectively sealing said opening when said opening is closed by said means for selectively sealing said opening, and whereby air within said inflation chamber is automatically vented out of said inflation chamber through said opening when said opening is moved level to or above said head end of said inflation chamber and said opening is opened.

4. The device of claim 3 wherein said means for selectively sealing said opening comprises a hook and loop closure system.

5. The device of claim 1 wherein said inflation chamber is formed between adjacent air and water impervious materials.

6. The device of claim 1 wherein said means for constricting said second end of said tube comprises: a cup-shaped cap having a closed end and an open end, said cap biased away from said second end of said tube, said cap containing an air and water impermeable seal disposed within said closed end of said cap, said cap disposed to receive said second end of said tube in said open end of said cap; and, means for moving said closed end of said cap toward said second end of said tube against said bias thereby bringing said seal into sealing contact with said second end of said tube.

7. The device of claim 6 wherein said means for moving said closed end of said cap toward said second end of said tube against said bias comprises at least one cord attached to said cap and disposed along said tube ending in a means for grasping said cord whereby said diver, by pulling on said means for grasping said cord, pulls said cap, and thereby said seal, into sealing contact with said second end of said tube.

8. The device of claim 6 wherein said bias comprises a spring abut said tube and contained in part within said cap, disposed colineally with said tube and said cap, having a direction of force, when compressed, away from said second end of said tube.

9. The device of claim 1 wherein said means for constricting said second end of said tube comprises: an air and water impermeable gasket biased away from said second end of said tube; and, a means for bringing said gasket, against said bias, into sealing contact with said second end of said tube.

10. The device of claim 9 wherein said means for bringing said gasket into sealing contact with said second end of said tube comprises a cord having one end attached to said gasket and the other end of said cord disposed along said tube ending in a means for grasping said cord whereby said diver, by pulling on said means for grasping said cord, pulls said gasket into sealing contact with said second end of said tube.

11. The device of claim 9 wherein said bias comprises a spring having a direction cf force, when compressed, away from said second end of said tube.

12. The device of claim 1 wherein said means for directing exhalant from said diver comprises an inflation tube connecting said inflation chamber and said snorkel.

13. The device of claim 12 further comprising a purge valve functionally located along the path of air through said inflation tube.

14. The device of claim 1 wherein said means for preventing air within said inflation chamber from exiting said inflation chamber through said means for directing exhalant comprises a purge valve.

15. A dive vest for use by a diver comprising:

a dive vest made of air and water impervious material, said dive vest having a head end attached to said diver's neck and shoulder area, and an opposing end opposite said head end, said dive vest including an inflation chamber capable of receiving and storing air, said inflation chamber having a head end, corresponding to said head end of said dive vest, and a bottom end, corresponding to said opposing end of said dive vest, said inflation chamber having an exhaust port, said exhaust port being arranged to automatically vent air within said inflation chamber to the exterior of said dive vest when said diver places the said head end of said dive vest below said exhaust port preparatory to diving below the water's surface, said inflation chamber also having means for placing air in said inflation chamber.

16. The device of claim 15 wherein said exhaust port comprises a non-sealed opening in said inflation chamber, said non-sealed opening located at said bottom end of said inflation chamber whereby air is maintained within said inflation chamber by hydrostatic pressure when said head end of said inflation chamber is higher than said non-sealed opening and whereby air within said inflation chamber is automatically vented out of said inflation chamber through said non-sealed opening when said non-sealed opening is moved level to or above said head end of said inflation chamber.

17. The device of claim 15 wherein said exhaust port comprises: an opening; and, means for selectively sealing said opening whereby air is maintained within said inflation chamber by hydrostatic pressure when said head end of said inflation chamber is higher than said opening and by said means for selectively sealing said opening when said opening is closed by said means for selectively sealing said opening, and whereby air within said inflation chamber is automatically vented out of said inflation chamber through said opening when said opening is moved level to or above said head end of said inflation chamber and said opening is opened.

18. The device of claim 17 wherein said means for selectively sealing said opening comprises a hook and loop closure system.

19. The device of claim 15 wherein said inflation chamber is formed between adjacent air and water impervious materials.

20. The device of claim 15 wherein said means for placing air in said inflation chamber comprises: an inflation tube having a first and second end, said inflation tube connected at said first end to said inflation chamber; and, means for preventing air from escaping from said inflation chamber through said inflation tube.

21. The device of claim 20 wherein said means for preventing air from escaping comprises a purge valve.

22. The device of claim 20 wherein said inflation tube is connected at said second end to a snorkel.

23. The device of claim 22 wherein said inflation tube is connected at said second end to a snorkel through means for preventing air from escaping comprising a purge valve.

24. A snorkel for use by a diver to inflate a dive vest having an inflatable region comprising:

a tube with a first and second end, said first end having a mouthpiece, said snorkel also having means for constricting said second end of said tube comprising a cup-shaped cap having a closed end and an open end, said cap biased away from said second end of said tube, said cap containing an air and water impermeable seal disposed within said closed end of said cap, said cap disposed to receive said second end of said tube in said open end of said cap; and, means for moving said closed end of said cap toward said second end of said tube against said bias thereby bringing said seal into sealing contact with said second end of said tube, whereby air is constricted from moving in or out of said second end of said tube, said snorkel further having means for directing exhalant from said diver into said inflatable region of said dive vest, and further having means for preventing air within said inflatable region from exiting said inflatable region through said means for directing exhalant from said diver into said inflatable region.

25. The device of claim 24 wherein said means for moving said closed end of said cap toward said second end of said tube against said bias comprises at least one cord attached to said cap and disposed along said tube ending in a means for grasping said cord whereby said diver, by pulling on said means for grasping said cord, pulls said cap, and thereby said seal, into sealing contact with said second end of said tube.

26. The device of claim 25 wherein said bias comprises a spring abut said tube and contained in part within said cap, disposed colineally with said tube and said cap, having a direction of force, when compressed, away from said second end of said tube.

27. The device of claim 24 wherein said means for constricting said second end of said tube comprises: an air and water impermeable gasket biased away from said second end of said tube; and, a means for bringing said gasket, against said bias, into sealing contact with said second end of said tube.

28. The device of claim 27 wherein said means for bringing said gasket into sealing contact with said second end of said tube comprises a cord having one end attached to said gasket and the other end of said cord disposed along said tube, said cord ending in a means for grasping said cord whereby said diver, by pulling on said means for grasping said cord, pulls said gasket into sealing contact with said second end of said tube.

29. The device of claim 28 wherein said bias comprises a spring having a direction of force, when compressed, away from said second end of said tube.

* * * * *